US006098206A

United States Patent [19]

Chou

[11] Patent Number: 6,098,206

[45] Date of Patent: Aug. 8, 2000

[54] WATERPROOF SWIMMING GOGGLES

[76] Inventor: Terry Chou, No. 12, Hsin Ho Herng Road, Tainan City, Taiwan

[21] Appl. No.: 09/338,558

[22] Filed: Jun. 23, 1999

[51] Int. Cl.[7] ..... A61F 9/02

[52] U.S. Cl. ..... 2/428

[58] Field of Search ..... 2/434, 437, 426, 2/428, 171.3, 436, 9

[56] References Cited

U.S. PATENT DOCUMENTS

| | | | |
|---|---|---|---|
| 5,603,125 | 2/1997 | Chou | 2/428 |
| 5,682,621 | 11/1997 | Park | 2/441 |
| 5,819,321 | 10/1998 | Wang | 2/428 |
| 5,857,221 | 1/1999 | Geneve et al. | 2/428 |
| 5,903,929 | 5/1999 | Chou | 2/441 |
| 5,950,248 | 9/1999 | Kawashima et al. | 2/441 |

*Primary Examiner*—John J. Calvert
*Assistant Examiner*—Katherine Moran
*Attorney, Agent, or Firm*—Rosenberg, Klein & Lee

[57] ABSTRACT

A pair of swimming goggles includes two lenses, two padding members, a frame, a bridge, and a strap. Each lens is made of transparent rigid material and includes an engaging section. Each padding member is made of soft, flexible, and extensible material and includes a hollow receiving section sized to be smaller than the lens such that the engaging section of an associated lens is fitted into the padding member by stretching the padding member. Each padding member further includes a padding section to be in close contact with user's face. The frame and the bridge are integrally formed by material that is slightly flexible and less extensible than the padding member. The frame includes two hollow receiving portions each having an inner diameter smaller than an outer diameter of the associated lens such that the engaging section of the associated lens that has been engaged with an associated padding member is fitted into an associated hollow receiving portion by stretching the frame.

5 Claims, 10 Drawing Sheets

WATERPROOF SWIMMING GOGGLES

BACKGROUND OF THE INVENTION

1. Field of the Invention

The present invention relates to a pair of swimming goggles that has improved waterproof effect and a reliable structure and that is convenient to use and comfort to wear.

2. Description of the Related Art

FIGS. 8 and 9 of the drawings illustrate a pair of conventional swimming goggles that includes two lenses 1', two padding members 2', a bridge 3', and a strap 4'. The lens 1' is made of transparent rigid material. Each lens 1' includes a flange 11' for engaging with an associated padding member 2'. Each lens 1' further includes a first connecting section 12' on an inner edge thereof for engaging with an end of a bridge 3' and a second connection section 13' on an outer edge thereof for engaging with an end of the strap 4'. Each padding member 2' includes an engaging section 21' on an outer face thereof for engaging with the flange 11' of an associated lens 1' and a padding flange 22' in close contact with an eye socket of the user. Nevertheless, the lenses 1' and the bridge 3' are separate and thus fail to provide an aesthetically pleasing effect. In addition, engagement between the lens 1' and the padding member 2' is not reliable and thus adversely affects the waterproof effect when the strap 4' is pulled.

FIGS. 10 and 11 illustrate another pair of conventional swimming goggles that includes two lenses 5', two frames 6', a bridge 7', and a strap 8'. The lens 5' is also made of transparent rigid material. Each lens 5' includes a connecting peripheral edge for engaging with an associated frame 6' by means of glue bonding or other suitable means. The frames 6' and the bridge 7' are integrally formed by the same plastic material. A padding section 61' is directly formed on an inner side of each frame 6' to be in close contact with the eye socket of the user. A connecting section 62' is directly formed on an end edge of each frame 6' for connecting with an end of the strap 8'. The frame 6' and the lens 5' cannot provide required waterproof effect (see FIG. 11*a*) when the strap 8' is pulled for wearing. As a result, ingress of water into the swimming goggles occurs. To the contrary, if the frames 6' and the bridge 7' are formed by more rigid material, the wearing comfort will be adversely affected.

FIG. 12 illustrates a further pair of conventional swimming goggles that includes two lenses 90', a frame 91', a padding member 92', two rings 93', and a strap 94'. The lenses 90' are also made of transparent rigid material. The frame 91' is made of rigid material and includes an annular groove 911' for engaging with the padding member 92'. The frame 91' further includes a connecting section 912' on each outer edge thereof for engaging with an associated end of the strap 94'. The frame 91' further includes a notch 913 in each outer edge thereof for engaging with an associated outer ring 93'. The padding member 92' is made of soft material and includes abutting edges formed on a front end thereof to which the edges of the lenses 90' abut. The padding member 92' further includes a padding section 922' formed on a rear end thereof. Each outer ring 93' is made of rigid material and sized to receive an associated lens 90' before the former is mounted to the frame 91. Each outer ring 93' includes an engaging section 931' for engaging with an associated notch 913' of the frame 91'.

It is, however, found that engagement between the padding member 92' and the annular groove 911' of the frame 91' is not reliable. Namely, the padding member 92' tends to disengage from the frame 91'. In addition, curvature of the rigid frame 91' is fixed, such that the user feels uncomfortable if his/her face is wider than the frame 91' and that the waterproof effect is poor if the frame 91 ' is too wide for the user's face.

The present invention is intended to provide a pair of swimming goggles that mitigates and/or obviate the above problems.

SUMMARY OF THE INVENTION

It is a primary object of the present invention to provide a pair of swimming goggles that has improved waterproof effect and a reliable structure and that is convenient to use and comfort to wear.

In accordance with one aspect of the invention, a pair of swimming goggles comprises two lenses, two padding members, a frame, a bridge, and a strap. Each lens is made of transparent rigid material and includes an engaging section. Each padding member is made of soft, flexible, and extensible material and includes a hollow receiving section sized to be smaller than the lens such that the engaging section of an associated lens is fitted into the padding member by means of stretching the padding member. Each padding member further includes a padding section to be in close contact with user's face. The frame and the bridge are integrally formed by material that is slightly flexible and less extensible than the padding member. The frame includes two hollow receiving portions each having an inner diameter smaller than an outer diameter of the associated lens such that the engaging section of the associated lens that has been engaged with an associated padding member is fitted into an associated hollow receiving portion by means of stretching the frame. The frame further includes a connecting section on each of two outer edges thereof for engaging with the strap.

In accordance with a second aspect of the invention, a pair of swimming goggles comprises two lenses, a frame, a padding member, a bridge, and a strap. Each lens includes an engaging section. The padding member is formed with a hollow receiving portion for receiving the engaging section of an associated lens. The padding member further includes a padding section to be in close contact with user's face. The frame and the bridge are integrally formed to include two compartments for respectively receiving the lenses. The frame further includes a connecting section on each of two outer edges thereof for engaging with the strap.

The lenses, frame, and padding member of the swimming goggles in accordance with the present invention are made of suitable material and thus provide reliable engagement and improved wearing comfort. Disengagement of the padding member as a result of impact is prevented, since the padding member engages with the lens before engaging with the frame. In addition, wearing comfort is improved, since the frame is flexible to be in close contact with the user's face, thereby providing improved wearing comfort and adaptation.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
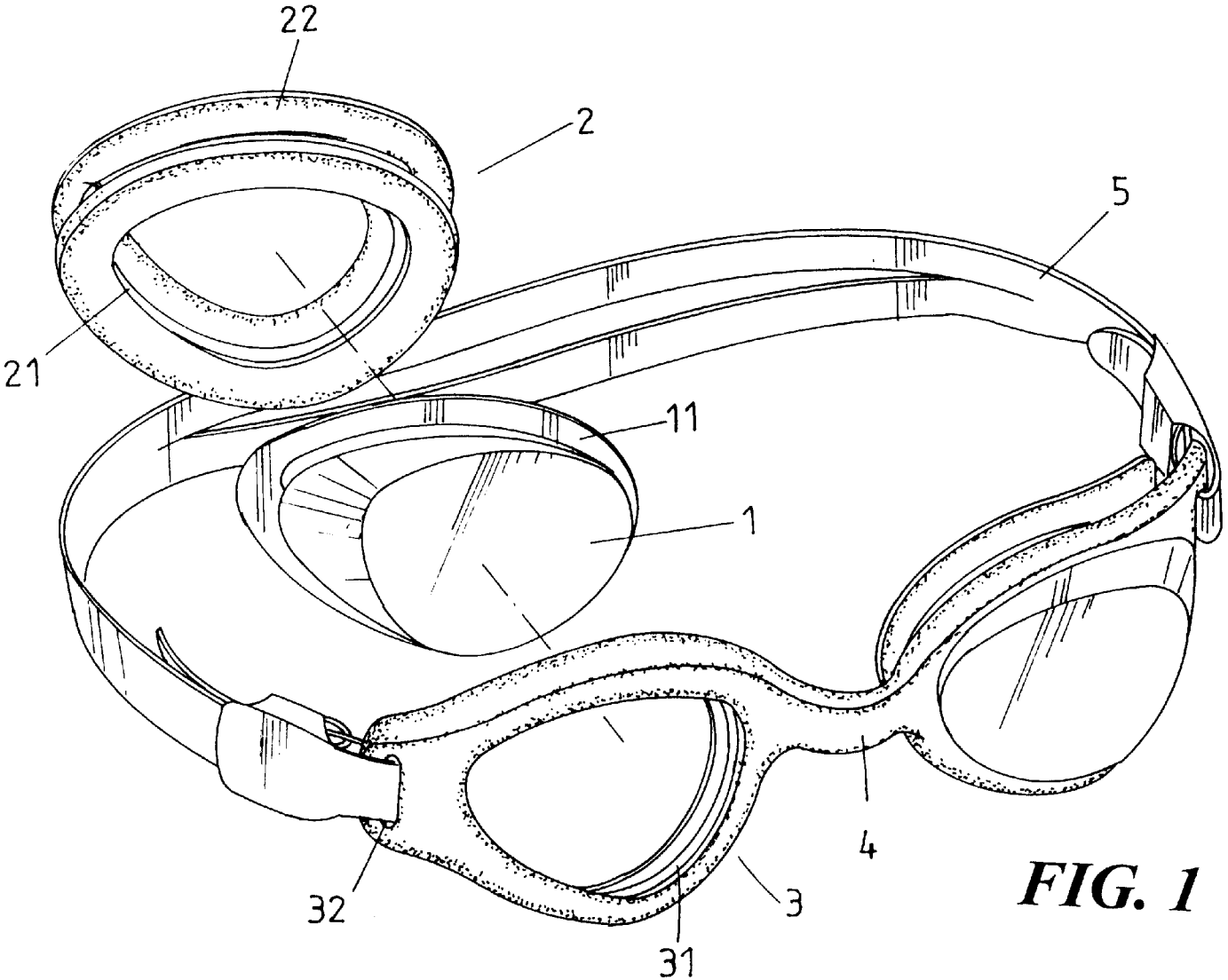
FIG. 1 is a perspective view, partly exploded, of a pair of swimming goggles in accordance with the present invention.
Figure 2:
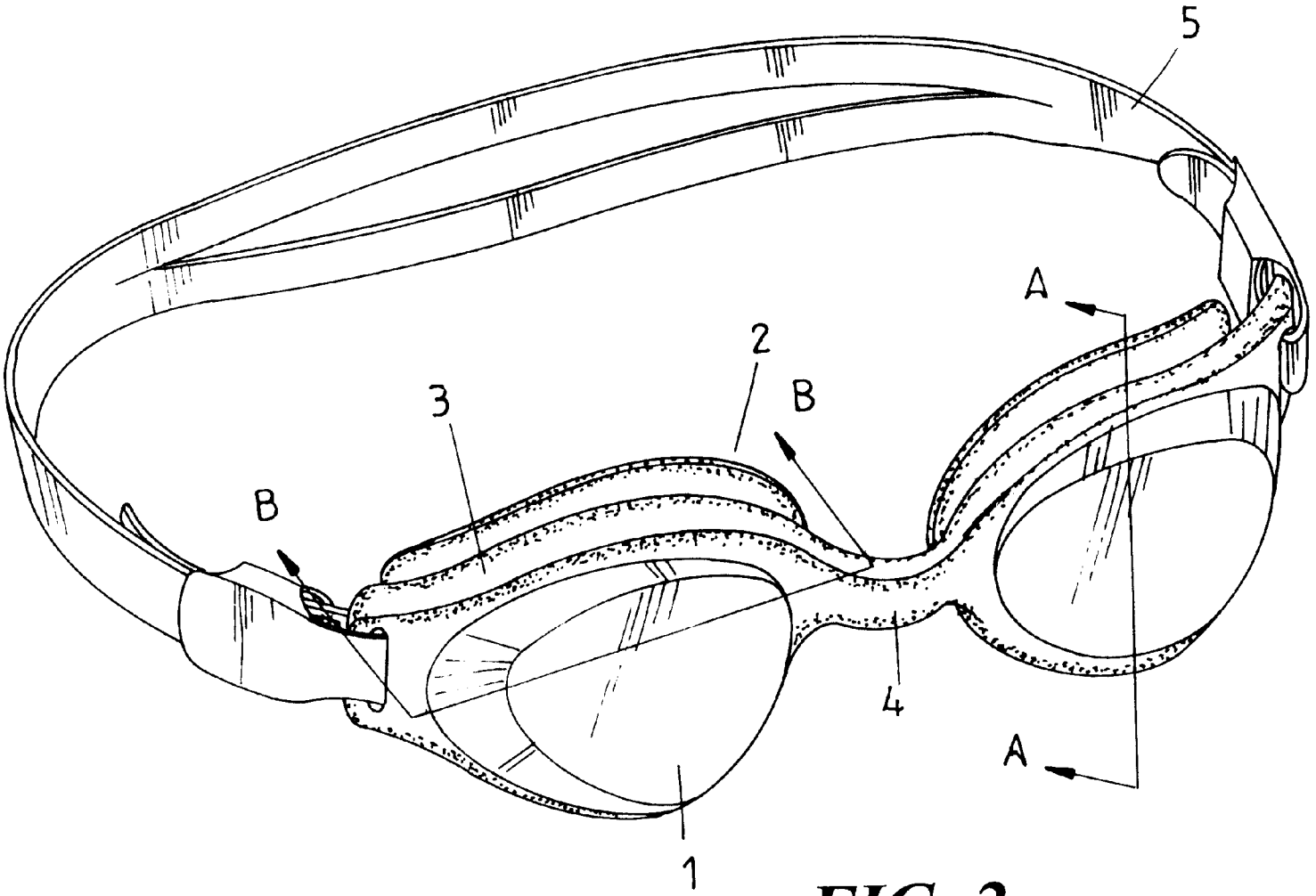
FIG. 2 is a perspective view of the pair of swimming goggles in accordance with the present invention.

Referring to FIGS. 1 through 7 and initially to FIGS. 1 and 2, a pair of swimming goggles in accordance with the present invention generally includes two lenses 1, two padding members 2, a frame 3, a bridge 4, and a strap 5. Each lens 1 is made of transparent rigid material and includes an engaging section 11 in the form of, e.g., a peripheral flange. Each padding member 2 is substantially ring-like and is made of soft, flexible, and extensible material. Each padding member 2 includes a hollow receiving section 21 that is sized to be smaller than the lens 1 such that the engaging section 11 of lens 1 can be fitted into the padding member 2 by means of stretching the padding member 2. Each padding member 2 further includes a padding section 22 to be in close contact with the user's face.

The frame 3 and the bridge 4 are integrally formed by material that is slightly flexible and less extensible than the padding member 2. The frame 3 includes two compartments or hollow receiving portions 31 each having an inner diameter smaller than the outer diameter of the lens 1 such that the engaging section 11 of lens 1 that has been engaged with an associated padding member 2 can be fitted into the compartment 31 by means of stretching the frame 3. The frame 3 further includes a connecting section 32 on each of two outer edges thereof for engaging with an associated end of the strap 5.

Figure 3:
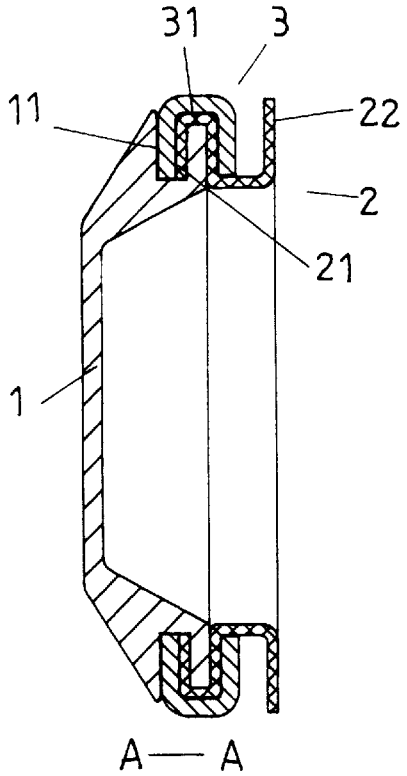
FIG. 3 is a sectional view taken along line A—A in FIG. 2.
Figure 4:
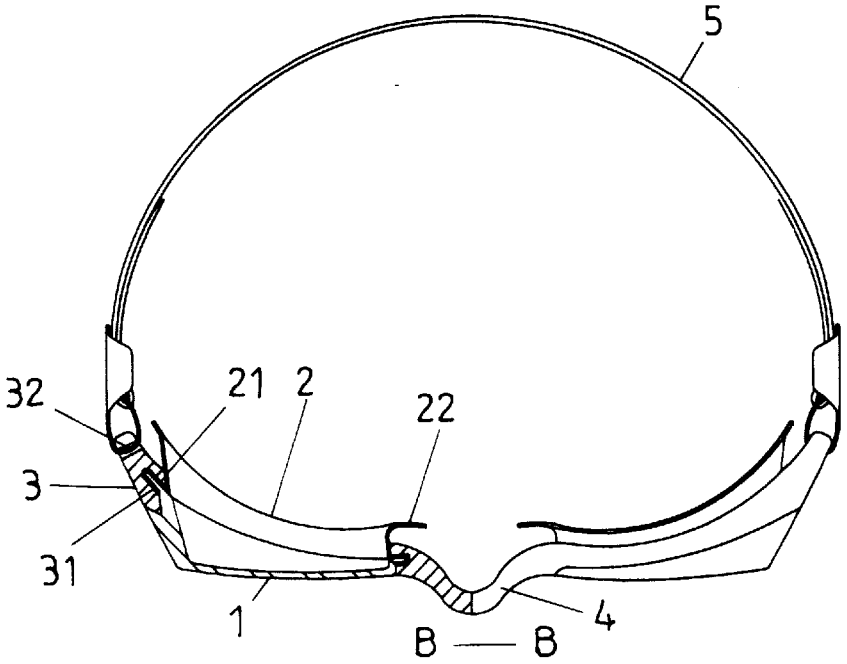
FIG. 4 is a top view, partly sectioned along line B—B in FIG. 2, of the pair of swimming goggles in accordance with the present invention.

Referring to FIGS. 2 through 4, since the padding members 2 are made of material softer than the frame 3, the padding members 2 provide a comfort contact with the user's face. In addition, the engagement between each padding member 2 and the associated lens 1 is reliable, since the assembled padding member/lens is mounted and thus retained in the compartment 31 of the frame 3, thereby preventing disengagement of the padding member 2. A further advantage of the pair of swimming goggles in accordance with the present invention is that the frame 3 and the bridge 4 are made of material that is less extensible than the padding member 2 such that the frame 3 is less likely to deform when the strap 5 is pulled. The adaptive arrangement in the hardness of the lenses 1 (hardest), the frame 3 (a little soft), and the padding members 2 (soft) provides excellent waterproof effect and improved wearing comfort.

Figure 5:
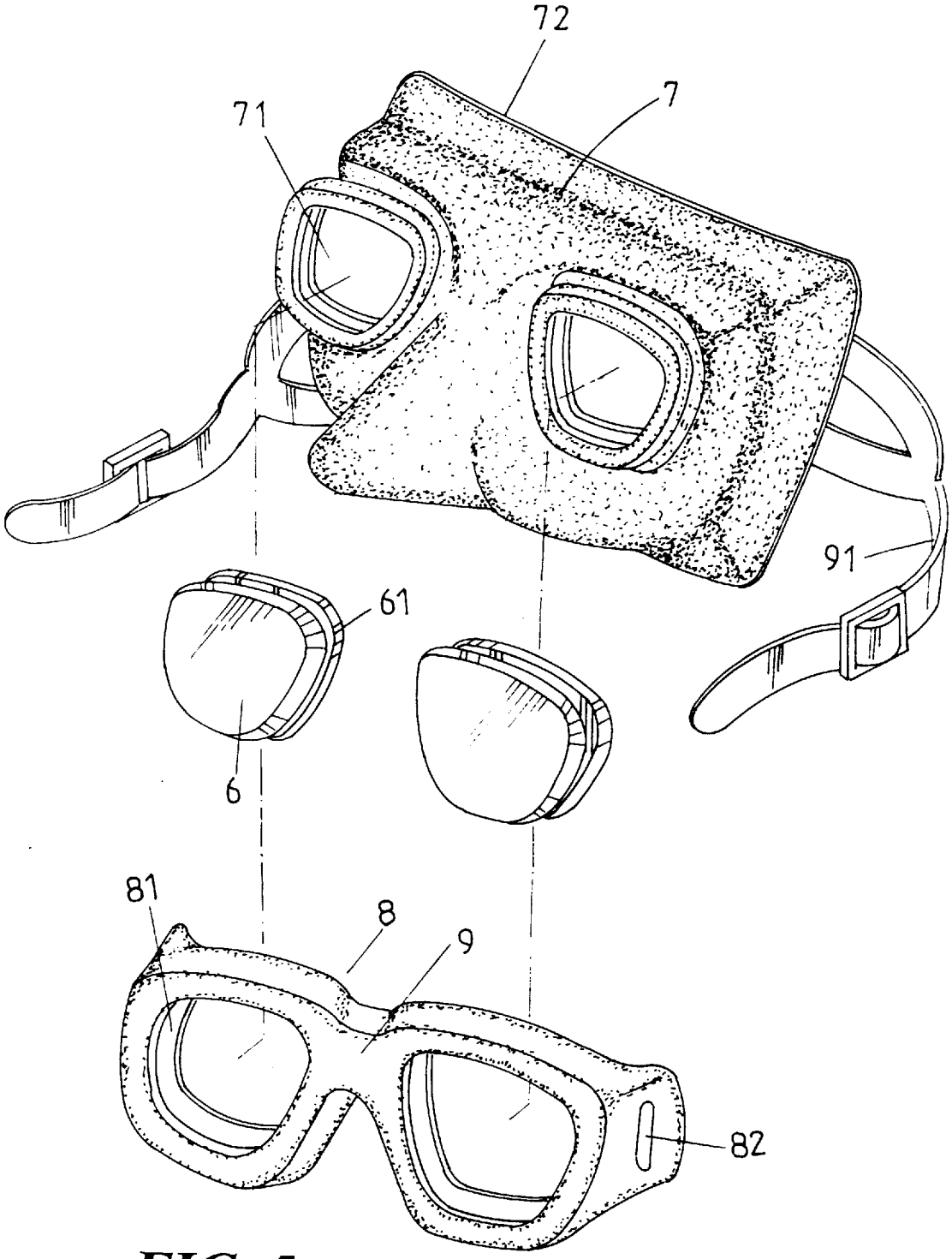
FIG. 5 is an exploded perspective view of a second embodiment of a pair of swimming goggles in accordance with the present invention.
Figure 6:
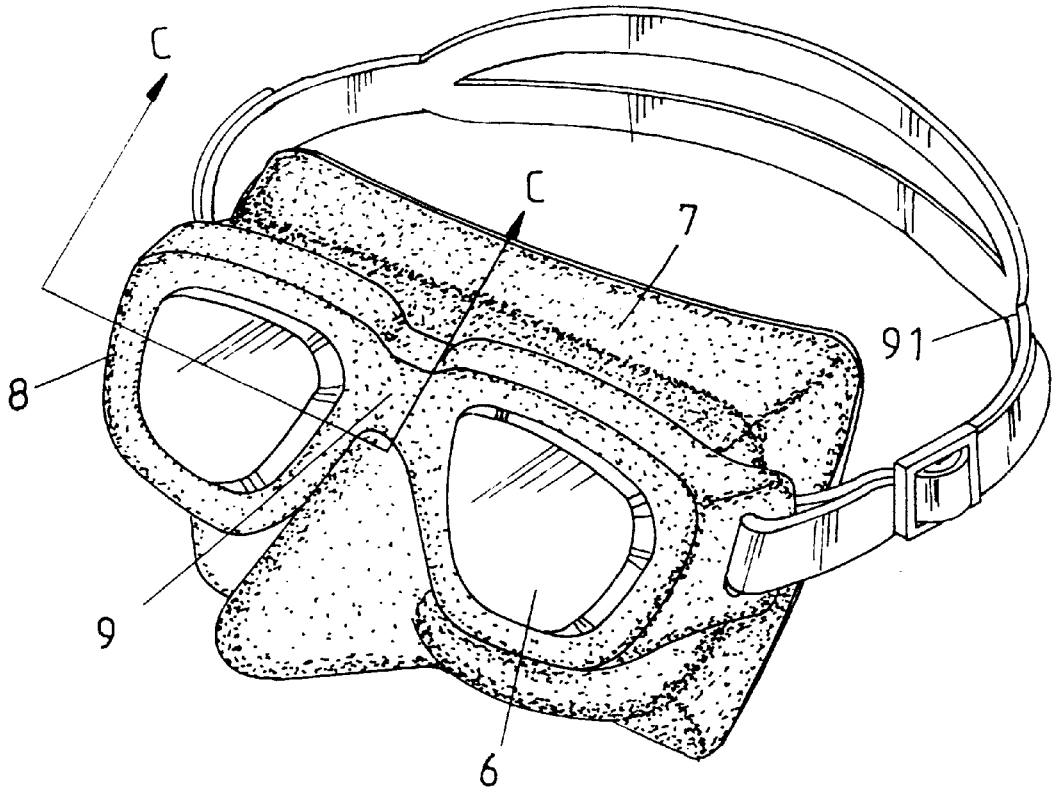
FIG. 6 is a perspective view of the second embodiment of the pair of swimming goggles in accordance with the present invention.
Figure 7:
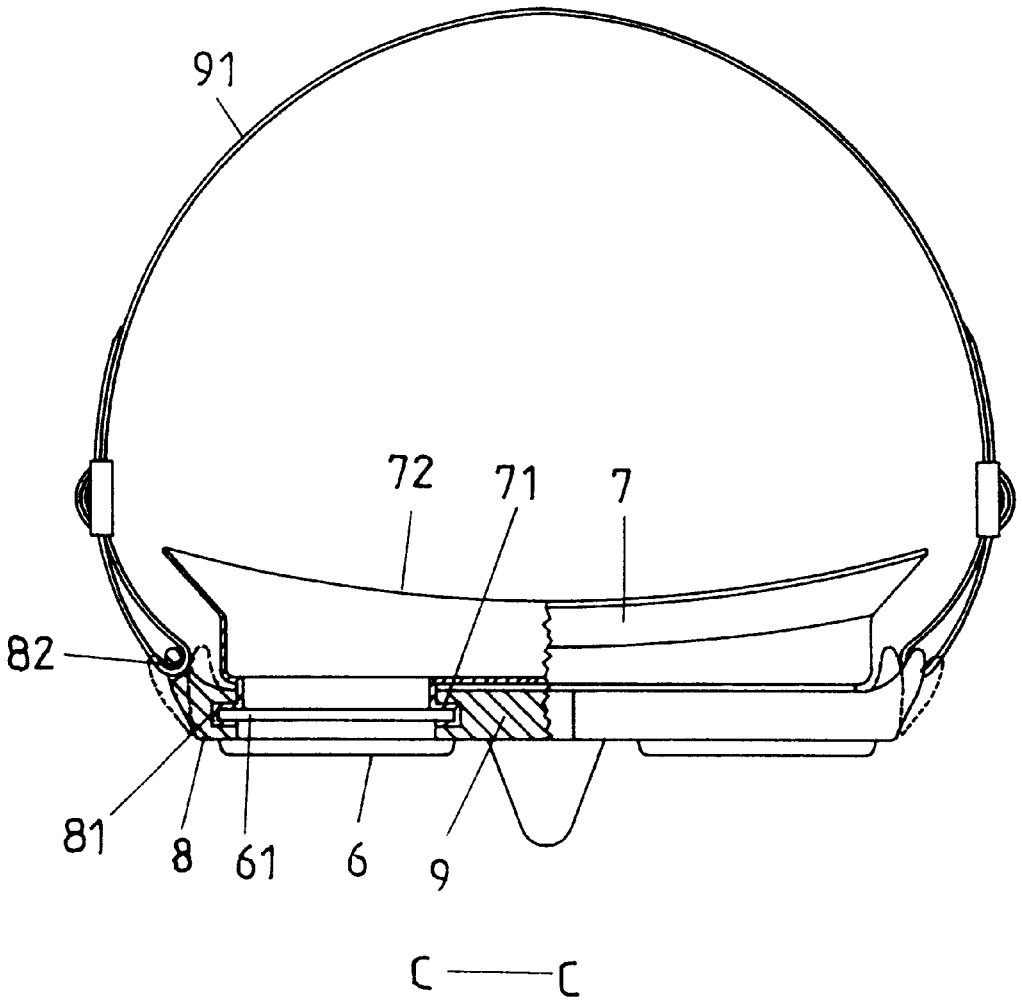
FIG. 7 is a top view, partly sectioned along line C—C in FIG. 6, of the second embodiment of the pair of swimming goggles in accordance with the present invention.
Figure 8:
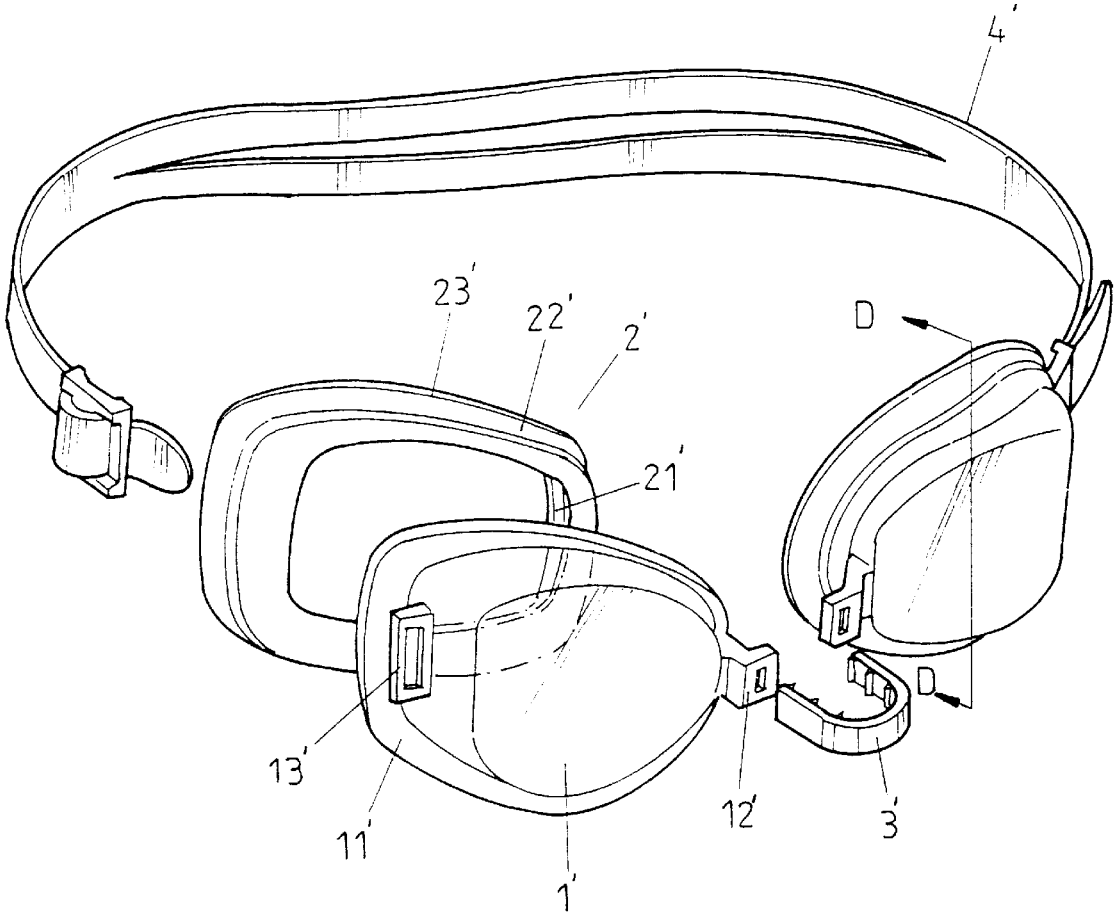
FIG. 8 PRIOR ART
FIG. 8 is a perspective view, partly exploded, of a pair of conventional swimming goggles.
Figure 9:
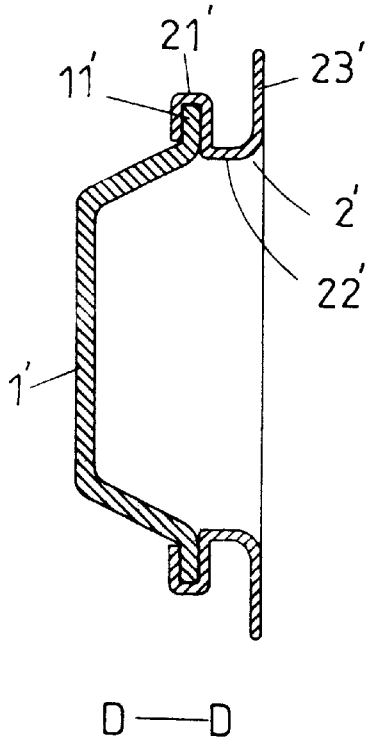
FIG. 9 PRIOR ART
FIG. 9 is a sectional view along line D—D in FIG. 8.
Figure 10:
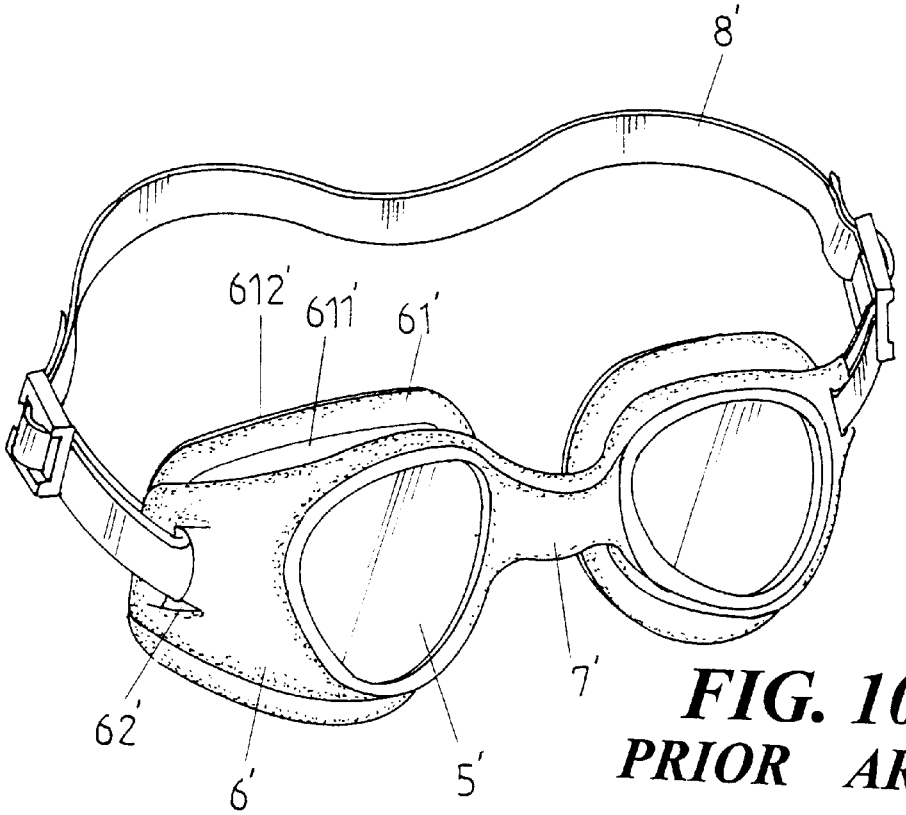
FIG. 10 PRIOR ART
FIG. 10 is a perspective view of another pair of conventional swimming goggles.
Figures 11, 11A:
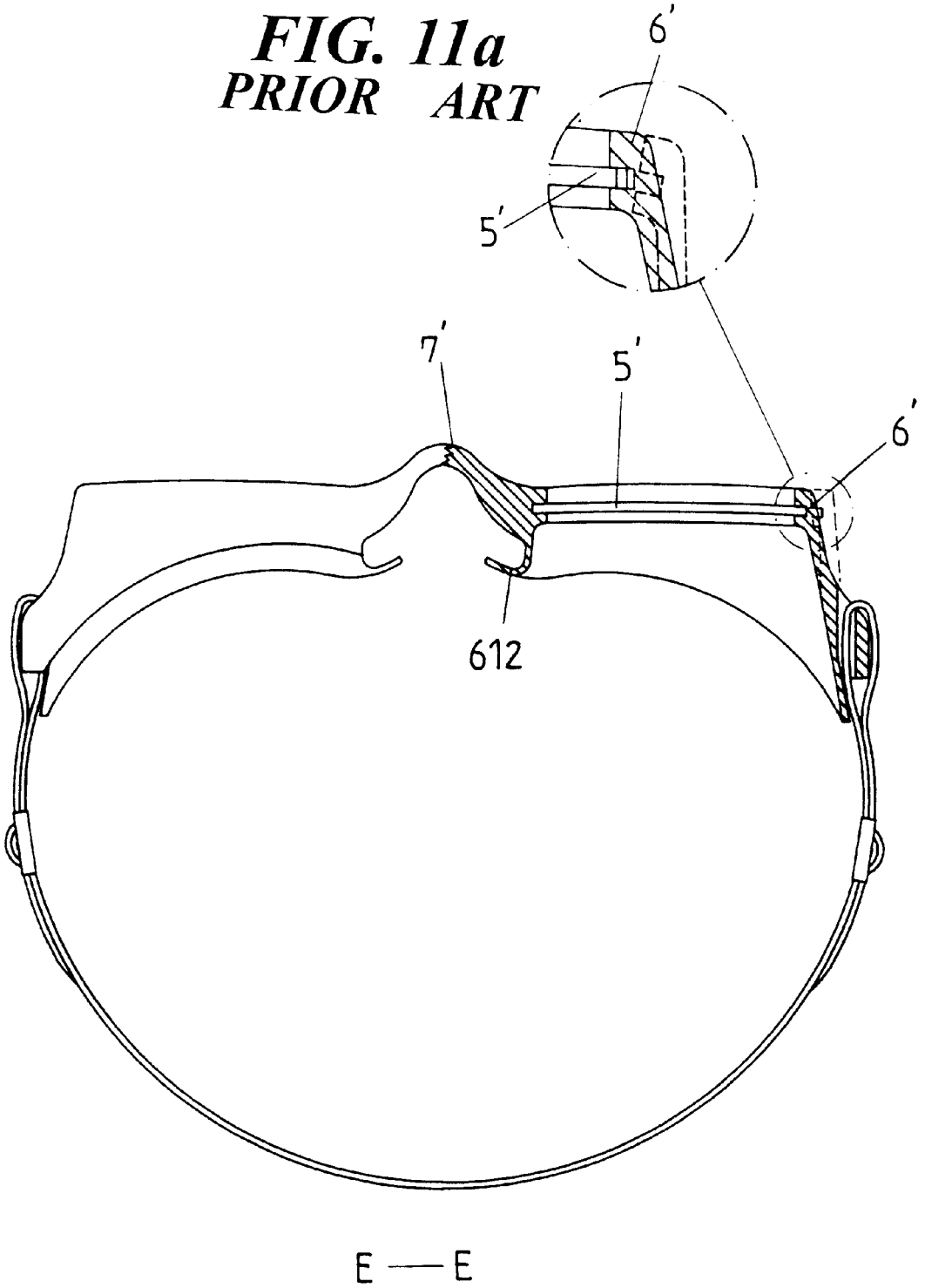
FIG. 11a PRIOR ART
FIG. 11 PRIOR ART
FIG. 11 is a top view, partly sectioned, of the pair of conventional swimming goggles in FIG. 10.
FIG. 11*a* is an enlarged view of a circle in FIG. 11.
Figure 12:
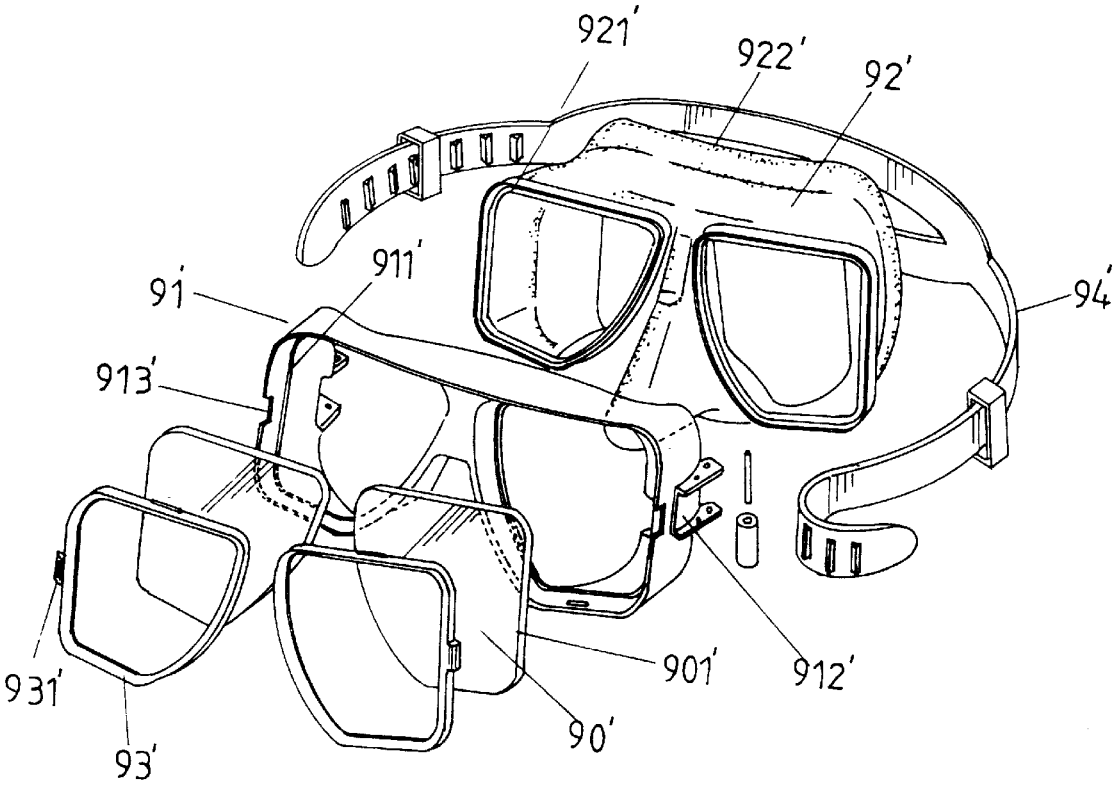
FIG. 12 PRIOR ART
FIG. 12 is an exploded perspective view of a further pair of conventional swimming goggles in accordance with the present invention.

FIGS. 5 through 7 of the drawings illustrate another embodiment of a pair of swimming goggles in accordance with the present invention that includes, from hardest to softest, two lenses 6, a frame 8, a padding member 7, a bridge 9, and a strap 91. Each lens 6 includes an engaging section 61. The padding member 7 is formed with two hollow receiving portions 71 each for receiving the engaging section 61 of an associated lens 6. The padding member 7 further includes a padding section 72 formed on a rear side thereof to be in close contact with the user's face. The frame 8 and the bridge 9 are integrally formed to include two compartments 81 for respectively receiving the lenses 6. The frame 8 further includes a connecting section 82 on each of two outer edges thereof for engaging with an associated end of the strap 91.

When in use, as show in FIGS. 6 and 7, the padding member 7 engages with the frame 8 after the former has been engaged with the lenses 6 to provide reliable engagement between the padding member 7 and the frame 8. In addition, the wearing comfort and adaptation are improved, since the frame 8 and the bridge 9 are made of material with slight flexibility such that the frame 8 may be properly deformed to be in close contact with the user's face regardless of contour of the user.

According to the above description, it is appreciated that the lenses, frame, and padding member of the swimming goggles in accordance with the present invention are made of suitable material and thus provide reliable engagement and improved wearing comfort. Disengagement of the padding member as a result of impact is prevented, since the padding member engages with the lens before engaging with the frame. In addition, wearing comfort is improved, since the frame is flexible to be in close contact with the user's face, thereby providing improved wearing comfort and adaptation.

Although the invention has been explained in relation to its preferred embodiment, it is to be understood that many other possible modifications and variations can be made without departing from the spirit and scope of the invention as hereinafter claimed.

What is claimed is:

1. Waterproof swimming goggles, comprising: two lenses formed of a transparent rigid material, two padding members formed of a soft, flexible and extensible material, a frame, a bridge, and a strap, each said lens including an engaging section, each said padding member including a hollow receiving section sized to be smaller than the lens, the engaging section of each of said lenses being received into said hollow receiving section of a respective one of the padding members in resilient contact therewith, each said padding member further including a padding section adapted to be in close contact with a user's face, the frame and the bridge being integrally formed from a flexible material that is less extensible than the material of said padding member, the frame including two hollow receiving portions, each having an inner diameter smaller than an outer diameter of each lens, the engaging section of each lens secured within the respective one of said padding members being further received within said hollow receiving portion of said frame and being maintained therein in resilient engagement therewith, the frame further including a connecting section on each of two outer edges thereof for engaging with the strap.

2. Waterproof swimming goggles, comprising:

(a) a pair of lenses, each said lens having a front portion and a flange extending peripherally around said front portion of said lens;

(b) a padding member having a front section and a rear section thereof, said padding member including:

at least one opening for securing at least one of said lenses to said padding member thus forming a watertight joint therebetween, an engagement groove coinciding with a contour of said at least one opening for receiving therein said flange of said at least one lens, and a contact padding section extending externally of said at least one opening of said padding member at said rear section thereof for intimate contact with a user's face;

(c) a frame member, including:

a pair of frame portions coupled at inner ends thereof by a central bridge, each of said frame portions of said frame member having an opening for passing through said front portion of a respective one of said lens, and a connecting section at an outer end of said frame portion opposite to said inner end thereof, each said frame portion of said frame member overlapping said watertight joint formed between said padding member and said flange of said respective lens, thereby enhancing the watertight sealing therebetween; and (d) a strap secured at two ends thereof to said connecting sections of said frame portions of said frame member, thereby securing said frame member to the user's head, and maintaining said padding member with said lenses fitted thereinto in contact with the user's face.

3. The waterproof swimming goggles of claim 2, further including a pair of separate padding members, each having a single said opening for receiving a single one of said pair of lenses therein.

4. The waterproof swimming goggles of claim 2, wherein said padding member includes a pair of said openings for receiving a pair of said lenses therein.

5. The waterproof swimming goggles of claim 2, wherein said frame member is formed of a first flexible material, wherein said padding member is formed of a second flexible material, said second flexible material being more resilient than said first flexible material.

* * * * *